US007857917B2

(12) United States Patent
Fukunaga et al.

(10) Patent No.: US 7,857,917 B2
(45) Date of Patent: Dec. 28, 2010

(54) METHOD OF PRODUCTION OF STEEL FOR WELDED STRUCTURES EXCELLENT IN LOW TEMPERATURE TOUGHNESS OF WELD HEAT AFFECTED ZONE

(75) Inventors: Kazuhiro Fukunaga, Kimitsu (JP); Yasushi Mizutani, Kimitsu (JP); Rikio Chijiiwa, Kimitsu (JP); Yoshiyuki Watanabe, Kimitsu (JP)

(73) Assignee: Nippon Steel Corporation, Tokyo (JP)

( * ) Notice: Subject to any disclaimer, the term of this patent is extended or adjusted under 35 U.S.C. 154(b) by 644 days.

(21) Appl. No.: 11/632,735

(22) PCT Filed: Jul. 21, 2005

(86) PCT No.: PCT/JP2005/013775

§ 371 (c)(1),
(2), (4) Date: Jan. 17, 2007

(87) PCT Pub. No.: WO2006/009299

PCT Pub. Date: Jan. 26, 2006

(65) Prior Publication Data

US 2007/0193664 A1 Aug. 23, 2007

(30) Foreign Application Priority Data

Jul. 21, 2004 (JP) ..... 2004-213510
Jan. 18, 2005 (JP) ..... 2005-010581

(51) Int. Cl.
*C21D 8/02* (2006.01)

(52) U.S. Cl. ..... 148/541; 148/547; 148/661; 148/663

(58) Field of Classification Search ..... 148/541, 148/547, 661, 663
See application file for complete search history.

(56) References Cited

U.S. PATENT DOCUMENTS

RE31,251 E * 5/1983 Nakasugi et al. ..... 148/541

FOREIGN PATENT DOCUMENTS

EP 1 354 973 A1 10/2003

(Continued)

OTHER PUBLICATIONS

Human-English translation of Japanese patent 03-264614, Saito Naoki et al., Nov. 25, 1991.*

(Continued)

*Primary Examiner*—Deborah Yee
(74) *Attorney, Agent, or Firm*—Kenyon & Kenyon LLP

(57) ABSTRACT

The present invention provides a high strength thick steel plate for marine structures superior in weldability and low temperature toughness of the HAZ, which is able to be produced at a low cost without use of a complicated method of production, and a method of production of the same, that is, steel for welded structures excellent in low temperature toughness of the weld heat affected zone and a method of production of the same characterized by casting molten steel containing, by mass %, C: 0.03 to 0.12%, Si: 0.05 to 0.30%, Mn: 1.2 to 3.0%, P: 0.015% or less, S: 0.001 to 0.015%, Cu+Ni: 0.10% or less, Al: 0.001 to 0.050%, Ti: 0.005 to 0.030%, Nb: 0.005 to 0.10%, and N: 0.0025 to 0.0060% by the continuous casting method, making the cooling rate from near the solidification point to 800° C. in the secondary cooling at that time 0.06 to 0.6° C./s, hot rolling the obtained slab, and cooling it from a temperature of 800° C. or more.

3 Claims, 1 Drawing Sheet

FOREIGN PATENT DOCUMENTS

| | | | | |
|---|---|---|---|---|
| JP | 55-26164 | | | 7/1980 |
| JP | 61-106722 | | * | 5/1986 |
| JP | 2-175815 | A | | 7/1990 |
| JP | 3-264614 | | | 11/1991 |
| JP | 5-171341 | | | 7/1993 |
| JP | 6-57371 | A | | 3/1994 |
| JP | 6-93332 | | | 4/1994 |
| JP | 6-279848 | A | | 10/1994 |
| JP | 7-252586 | | | 10/1995 |
| JP | 2837732 | B2 | | 12/1998 |
| JP | 11-279684 | | | 10/1999 |
| JP | 2001-64745 | | | 3/2001 |
| JP | 2001-164333 | | | 6/2001 |
| JP | 2003-293089 | A | | 10/2003 |
| JP | 3468168 | B2 | | 11/2003 |
| JP | 2004-3012 | A | | 1/2004 |
| JP | 2004-143555 | A | | 5/2004 |
| KR | 2003-81050 | | | 10/2003 |
| WO | WO 2004-050935 | A1 | | 6/2004 |

OTHER PUBLICATIONS

European Search Report issued in connection with EP 05 76 7334 issued Apr. 3, 2008.

English Translation of Korean Office Action dated Jun. 16, 2009 issued in corresponding Korean Application No. 10-2008-7023302.

* cited by examiner

METHOD OF PRODUCTION OF STEEL FOR WELDED STRUCTURES EXCELLENT IN LOW TEMPERATURE TOUGHNESS OF WELD HEAT AFFECTED ZONE

TECHNICAL FIELD

The present invention relates to a high strength thick steel plate or marine structures excellent in weldability and further excellent in low temperature toughness of the HAZ and a method of production of the same. Further, the present invention can be broadly applied to buildings, bridges, ships, and construction machines.

BACKGROUND ART

In the past, as a method of production of steel excellent in weldability for the high strength steel used as steel for marine structures, the technique of controlling the cooling rate after hot rolling so as to reduce the Pcm, an indicator of weldability, has been known. Further, as a method of production of steel excellent in toughness at the HAZ (heat affected zone), for example, as described in Japanese Patent Publication (A) No. 5-171341, the technique of adding Ti to the steel material and using Ti oxides (below, TiO) as nuclei for promoting the formation of intragranular ferrite (IGF) has been known. Still further, as described in Japanese Patent Publication (B2) No. 55-26164, Japanese Patent Publication (A) No. 2001-164333, etc., the art of making Ti nitrides (below, TiN) disperse in the matrix so as to suppress the grain growth of the matrix at the time of reheating by the pinning effect and thereby secure the HAZ toughness and, as described in Japanese Patent Publication (A) No. 11-279684, the art that the Ti—Mg oxides dispersed in a matrix not only suppress grain growth at the time of reheating due to the pinning effect, but also make the ferrite finer due to the effect of promotion of formation of IGF and thereby secure the HAZ toughness are known. However, the technique of producing the above excellent HAZ toughness steel has the problems of requiring extremely complicated processes and is high in cost.

Further, in the art for making TiO or TiN finely disperse in steel to make the HAZ structure finer, the optimal values of the chemical compositions of the TiO and TiN particles and the particle sizes are also being studied. For example, Japanese Patent Publication (A) No. 2001-164333 describes that in a steel material with a ratio of Ti and N (Ti/N) of 1.0 to 6.0, including TiN particles with a particle size of 0.01 to 0.10 μm in the steel material before welding in an amount of $5\times10^5$ to $1\times10^6/mm^2$ enables steel excellent in HAZ toughness to be produced.

However, to get particles to disperse as aimed at using the technique described in Japanese Patent Publication (A) No. 2001-164333, it is described that aging for 10 minutes or more at the slab cooling stage, that is, between 900 to 1300° C., is necessary. This aging at a high temperature is extremely difficult and is not preferred from the viewpoint of the heat efficiency and production capability.

On the other hand, according to Japanese Patent Publication (A) No. 7-252586, when MnS is formed in steel, the MnS forms a nuclei in the HAZ structure for promotion of formation of IGF and the crystal grain size is effectively made finer, so it is possible to secure the desired toughness. However, while there is no clear reason, since an upper limit value is set for the amount of addition of Mn in actual steel, the obtained amount of MnS is not sufficient for bringing out the effect of promotion of formation of IGF to the maximum extent.

Further, in Japanese Patent Publication (A) No. 3-264614, it is considered that in the interaction of formation of TiN and MnS, TiN functions as nuclei for precipitation of MnS. Further, an invention calling for the cooling rate at the time of solidification to be made 5.0° C./min (about 0.08° C./s) or less in the range of 1000° C. to 600° C. for the effective use of these precipitates has been proposed, but the reason for this is not quantitatively explained. For this reason, the optimal cooling rate is unclear.

DISCLOSURE OF THE INVENTION

The present invention provides a high strength thick steel plate for a marine structure excellent in weldability and low temperature toughness of the HAZ able to be produced at a low cost without using a complicated method of production and provides a method of production of the same. The gist of the present invention is as follows:

(1) Steel for a welded structure excellent in low temperature toughness of the weld heat affected zone (HAZ) characterized by containing, by mass %, C: 0.03 to 0.12%, Si: 0.05 to 0.30%, Mn: 1.2 to 3.0%, P: 0.015% or less, S: 0.001 to 0.015%, Cu+Ni: 0.10% or less, Al: 0.001 to 0.050%, Ti: 0.005 to 0.030%, Nb: 0.005 to 0.10%, N: 0.0025 to 0.0060%, and a balance of iron and unavoidable impurities and by the steel structure having at least 80% of a bainite structure.

(2) A steel for welded structures excellent in low temperature toughness of the weld heat affected zone (HAZ) as set forth in (1) characterized by further containing, by mass %, one or more of Mo: 0.2% or less, V: 0.03% or less, Cr: 0.5% or less, Ca: 0.0035% or less, and Mg: 0.0050% or less.

(3) A method of production of steel for welded structures excellent in low temperature toughness of the weld heat affected zone (HAZ) characterized by preparing molten steel containing, by mass %, C: 0.03 to 0.12%, Si: 0.05 to 0.30%, Mn: 1.2 to 3.0%, P: 0.015% or less, S: 0.001 to 0.015%, Cu+Ni: 0.10% or less, Al: 0.001 to 0.050%, Ti: 0.005 to 0.030%, Nb: 0.005 to 0.10%, N: 0.0025 to 0.0060%, and the balance of iron and unavoidable impurities, casting it by a continuous casting method, making a cooling rate from near the solidification point in the secondary cooling at that time to 800° C. or more in temperature by 0.06 to 0.6° C./s, then hot rolling the obtained slab.

(4) A method of production of steel for welded structures excellent in low temperature toughness of the weld heat affected zone (HAZ) as set forth in (3), characterized by further containing, by mass %, one or more of Mo: 0.2% or less, V: 0.03% or less, Cr: 0.5% or less, Ca: 0.0035% or less, and Mg: 0.0050% or less.

(5) A method of production of steel for welded is structures excellent in low temperature toughness of the weld heat affected zone (HAZ) as set forth in (3) or (4), characterized by, as conditions of the hot rolling, reheating the slab to 1200° C. or less in temperature, then hot rolling in a pre-recrystallization temperature range by a cumulative reduction rate of 40% or more, finishing the hot rolling at 850° C. or more, then cooling from 800° C. or more in temperature by 5° C./s or more cooling rate to 400° C. or less.

(6) A method of production of steel for welded structures excellent in low temperature toughness of the weld heat affected zone (HAZ) as set forth in (5), the method of production characterized by cooling the steel obtained by the hot rolling, then tempering it at 400 to 650° C.

BEST MODE FOR WORKING THE INVENTION

Figure 1:
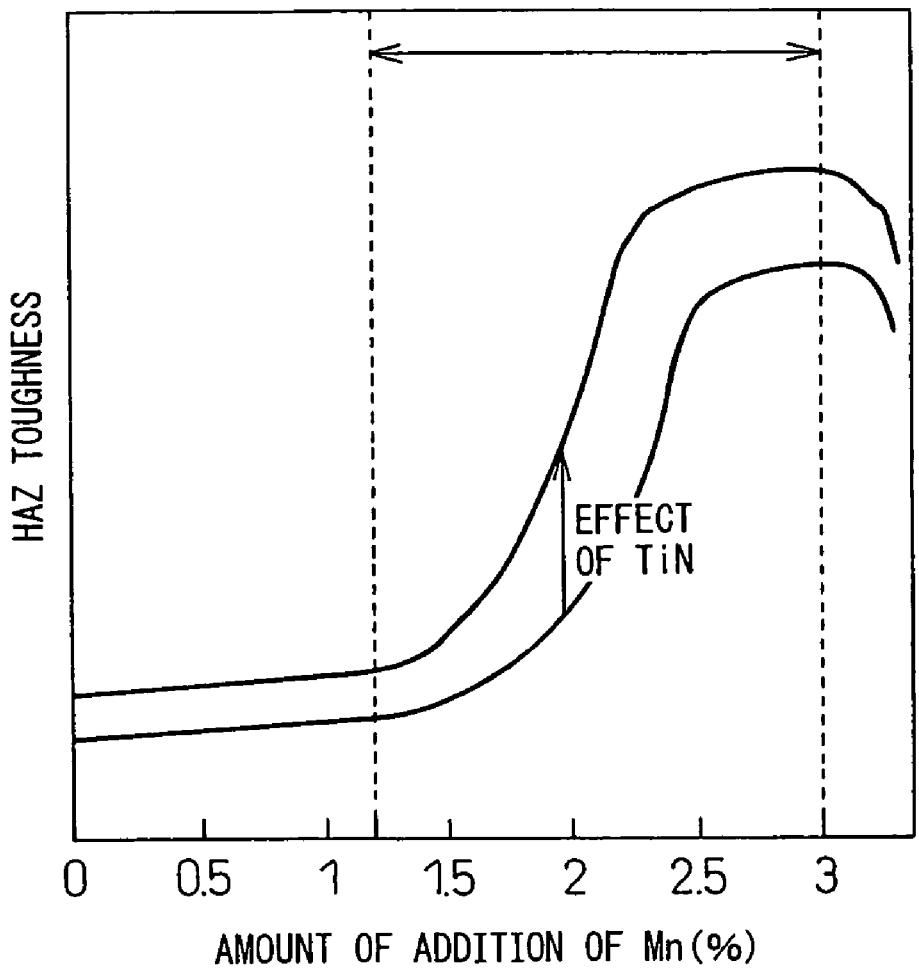
FIG. 1 is a view schematically showing the effects of Mn and TiN on the toughness value.

The present invention solves the above problem by adding a large amount of the relatively low alloy cost Mn so as to secure strength and toughness at a low cost and making combined use of the effect of suppression of crystal grain growth due to the pinning effect of TiN and the effect of promotion of formation of IGF by MnS so as to secure a superior HAZ toughness.

FIG. 1 is a view schematically showing the effects of Mn and TiN on the toughness value. Along with the increase in Mn, the toughness is improved. In particular, when the amount of addition of Mn becomes 1.2% or more, the effect becomes remarkable. However, around when the amount of addition of Mn exceeds 2.5%, the effect becomes saturated, while when over 3.0%, conversely the toughness deteriorates. Further, controlling the cooling rate so as to cause TiN to disperse in the steel at the time of casting high Mn steel improves the toughness in all Mn regions.

It was learned that a slab containing, by mass %, C: 0.08%, Si: 0.15%, Mn: 2.0%, P: 0.008%, S: 0.003%, Al: 0.021%, Ti: 0.01%, Nb: 0.01%, and N: 0.005%, which are in the ranges of chemical compositions shown in (1), has a volume ratio (volume of TiN/volume of steel) of $4.08\times10^{-4}$ when predicting the amount of TiN able to be produced in an equilibrium state using thermodynamic calculation. If using equation 1 of Nishikawa where R indicates the crystal particle size, r indicates the particle size of the precipitates, and f indicates the volume ratio of precipitates and volume ratio obtained by the previous calculation ($4.08\times10^{-4}$), the result is obtained that the crystal grain size obtained by the pinning effect of the precipitates becomes the 100 μm or less said to enable a excellent toughness to be sufficiently secured only when the particle size of the precipitates is 0.4 μm or less. The thermally stable TiN does not break down even during welding or other high temperature, short time heating. Growth of the crystal grain size is suppressed, so the effect of giving a high HAZ toughness is sufficiently maintained.

$$\bar{R} = \frac{4}{3} \cdot \frac{\bar{r}}{f^{\frac{2}{3}}}$$

According to equation 1, to obtain a slab having a structure with a crystal grain size of 1000 μm or less, it is necessary to make the particle size of the precipitates 0.4 μm or less. For this reason, the slab cooling rate must be controlled to 0.06° C./s or more, preferably 0.08° C./s or more, more preferably 0.1° C./s or more. Due to the effect of the sheet plate thickness, the cooling rate will greatly differ even in the same slab. In particular, the slab surface and the slab center greatly differ in temperature and also differ in temperature history. However, it is learned that the cooling rate remains in a certain range. Therefore, by controlling the slab cooling rate, it becomes possible to control the TiN which had only been able to be determined in terms of the Ti/N ratio in the past.

On the other hand, the effect of promotion of the formation of IGF by MnS is particularly effective when the effect of suppression of grain growth by the TiN at the time of welding was not sufficiently exhibited. That is, this is when the TiN ends up melting due to the heating. The present invention steel has a 2.0% or so large amount of Mn added to it and MnS is formed in a relatively high temperature range, so the amount of MnS produced at the welding temperature in the present invention steel increases over a steel to which a conventional amount of Mn is added and as a result the frequency of formation of IGF in the cooling after welding increases. For this reason, the HAZ structure is effectively made finer.

Further, various methods may be mentioned for the production of thick sheet plate having a high strength and a high toughness, but to secure toughness, the DQT method of direct quenching (DQ) the steel after hot rolling, then tempering (T) it is preferable. However, tempering is a process where the steel is once cooled, then reheated and held at that temperature for a certain time, so the cost rises. From the viewpoint of reducing costs, tempering should be avoided as much as possible. However, the present invention steel secures excellent toughness without tempering, so can produce high performance steel plate without causing a rise in costs. However, when toughness is particularly required, tempering can enable a steel material having further excellent toughness to be obtained.

Below, the reasons for limitation of the present invention will be explained. First, the reasons for limitation of the composition of the present invention steel material will be explained. The "%" in the following compositions means "mass %".

C is an element required for securing strength. 0.03% or more must be added, but addition of a large amount is liable to invite a drop in toughness of the HAZ, so the upper limit value was made 0.12%.

Si is used as a deoxidation agent and, further, is an element effective for increasing the strength of the steel by solution strengthening, but if less than 0.05% in content, its effect is small, while if over 0.30% is included, the HAZ toughness deteriorates. For this reason, Si was limited to 0.05 to 0.30%. Note that a further preferable content is 0.05 to 0.25%.

Mn is an element increasing the strength of the steel, so is effective for achieving high strength. Further, Mn bonds with S to form MnS. This becomes the nuclei for formation of IGF and promotes the increased grain fineness of the weld heat affected zone to thereby suppress deterioration of the HAZ toughness. Therefore, to maintain the desired strength and secure the toughness of the weld heat affected zone, a content of 1.2% or more is required. However, if over 3.0% of Mn is added, reportedly conversely the toughness is degraded. For this reason, Mn was limited to 1.2 to 3.0%. Note that the amount of Mn is preferably 1.5 to 2.5%.

P segregates at the grain boundaries and causes deterioration of the steel toughness, so preferably is reduced as much as possible, but up to 0.015% may be allowed, so P was limited to 0.015% or less.

S mainly forms MnS and remains in the steel. It has the action of increasing the fineness of the structure after rolling and cooling. 0.015% or more inclusion, however, causes the toughness and ductility in the sheet thickness direction to drop. For this reason, S has to be 0.015% or less. Further, to obtain the effect of refinement using MnS as the nuclei for formation of IGF, S has to be added in an amount of 0.001% or more. Therefore, S was limited to 0.001 to 0.015%.

Cu is a conventional element effective for securing strength, but causes a drop in the hot workability. To avoid this, the conventional practice has been to add about the same amount of Ni as the amount of addition of Cu. However, Ni is an extremely high cost element, therefore addition of a large amount of Ni would become a factor preventing the object of the present invention steel, the reduction of cost, to be achieved. Therefore, in the present invention steel, based on the idea than Mn enables the strength to be secured, Cu and Ni are not intentionally added. However, when using scrap to produce a slab, about 0.05% or so of each is liable to end up being unavoidably mixed in, so Cu+Ni was limited to 0.10% or less.

Al is an element required for deoxidation in the same way as Si, but if less than 0.001%, deoxidation is not sufficiently performed, while over 0.050% excessive addition degrades the HAZ toughness. For this reason, Al was limited to 0.001 to 0.050%.

Ti bonds with N to form TiN in the steel, so 0.005% or more is preferably added. However, if over 0.030% of Ti is added, the TiN is enlarged and the effect of suppression of growth of the crystal grain size by the TiN, which is the object of the present invention, is liable to be reduced. For this reason, Ti was limited to 0.005 to 0.030%.

Nb is an element which has the effect of expanding the pre-recrystallization region of the austenite and promoting increased fineness of the ferrite grains and forms Nb carbides and helps secure the strength, so inclusion of 0.005% or more is required. However, if adding over 0.10% of Nb, the Nb carbides easily cause HAZ embrittlement, so Nb was limited to 0.005 to 0.10%.

N bonds with Ti and forms TiN in the steel, so 0.0025% or more must be added. However, N also has an extremely large effect as a solution strengthening element, so if a large amount is added, it is liable to degrade the HAZ toughness. For this reason, the upper limit of N was made 0.0060% so as to not to have a large effect on the HAZ toughness and to enable the effect of TiN to be derived to the maximum extent.

Mo, V, and Cr are elements effective for improving the hardenability. To optimize the effect of refinement of the structure by TiN, one or more of these may be selected and included in accordance with need. Among these, V can optimize the effect of refinement of the structure as VN together with TiN and, further, has the effect of promoting precipitation strengthening by VN. Still further, inclusion of Mo, V, and Cr causes the $Ar_3$ point to drop, so the effect of refinement of the ferrite grains can be expected to become further larger. Further, addition of Ca enables the form of the MnS to be controlled and the low temperature toughness to be further improved, so when strict HAZ characteristics are required, Ca can be selectively added. Still further, Mg has the action of suppressing of austenite grain growth at the HAZ and making the grains finer and as a result improves the HAZ toughness, so when a strict HAZ toughness is required, Mg may be selectively added. The amounts of addition are Mo: 0.2% or less, V: 0.03% or less, Cr: 0.5% or less, Ca: 0.0035% or less, and Mg: 0.0050% or less.

On the other hand, when adding over 0.2% of Mo and over 0.5% of Cr, the weldability and toughness become impaired and the cost rises. When adding over 0.03% of V, the weldability and toughness are impaired. Therefore, these were made the upper limits. Further, addition of Ca over 0.0035% ends up detracting from the cleanliness of the steel and raising the susceptibility to hydrogen induced cracking, so 0.0035% was made the upper limit. Even if Mg is added in an amount over 0.005%, the extent of the effect of making the austenite finer becomes small and it is not smart cost wise, so 0.005% was made the upper limit.

The reason for making the steel structure an 80% or more bainite structure is that with a low alloy steel, to secure HAZ toughness and obtain sufficient strength, the structure must mostly be a bainite structure. If 80% or more, this can be achieved. Preferably 85% or more, further preferably 90% or more, should be a bainite structure.

Next, the production conditions of the steel material of the present invention will be explained.

The cast slab is preferably cooled by a cooling rate from near the solidification point to 800° C. of 0.06 to 0.6° C./s. According to the equation of Nishizawa, to maintain the crystal grain size at 100 μm or less by the pinning effect of the precipitates, the particle size of the precipitates must be 0.4 μm or less. To achieve this, a slab cooling rate of 0.06° C./s or more is necessary at the casting stage. Thermally stable TiN remains without breaking down even with subsequent welding or other high temperature, short time heating, so even at the time of welding or other heating, a pinning effect can be expected and the HAZ toughness can be secured. However, if the cooling rate of the slab becomes too large, the amount of fine precipitates increases and embrittlement of the slab may be caused. Therefore, the cooling of the slab after casting was limited to a cooling rate from near the solidification point to 800° C. of 0.06 to 0.6° C./s. Note that 0.10 to 0.6° C./s is preferable.

The heating temperature has to be a temperature of 1200° C. or less. The reason is that if heated to a high temperature over 1200° C., the precipitates created by control of the cooling rate at the time of solidification may end up remelting. Further, for the purpose of ending the phase transformation, 1200° C. is sufficient. Even growth of the crystal grains believed occurring at that time can be prevented in advance. Due to the above, the heating temperature was limited to 1200° C. or less.

In the present invention, the steel must be hot rolled by a cumulative reduction rate of at least 40% in the pre-recrystallization temperature range. The reason is that the increase in the amount of reduction in the pre-recrystallization temperature range contributes to the increased fineness of the austenite grains during rolling and as a result has the effect of making the ferrite grains finer and improving the mechanical properties. This effect becomes remarkable with a cumulative reduction rate in the pre-recrystallization range of 40% or more. For this reason, the cumulative amount of reduction in the pre-recrystallization range was limited to 40% or more.

Further, slab has to finish being hot rolled at 850° C. or more, then cooled from a 800° C. or more by a 5° C./s or more cooling rate down to 400° C. or less. The reason for cooling from 800° C. or more is that starting the cooling from less than 800° C. is disadvantageous from the viewpoint of the hardenability and the required strength may not be obtained. Further, with a cooling rate of less than 5° C./s, a steel having a uniform microstructure cannot be expected to be obtained, so as a result the effect of accelerated cooling is small. Further, in general, if cooling down to 400° C. or less, the transformation sufficient ends. Still further, in the present invention steels, even if continuing with the cooling by a 5° C./s or more cooling rate down to 400° C. or less, a sufficient toughness can be secured, so the result can be used as a steel material without particularly tempering it. Due to the above reasons, as production conditions of the present invention steel plate, the process is limited to completing the hot rolling of the slab at 850° C. or more, then cooling from a 800° C. or more temperature by a cooling rate of 5° C./s or more down to 400° C. or less.

When a particularly high toughness value is demanded and tempering the steel plate after hot rolling, the steel plate must be tempered at a temperature of 400 to 650° C. When tempering the steel plate, the higher the tempering temperature, the greater the driving force behind crystal grain growth. If over 650° C., the grain growth becomes remarkable. Further, with tempering at less than 400° C., probably the effect cannot be sufficiently obtained. Due to these reasons, when tempering steel plate after hot rolling, the tempering is limited to that performed under the conditions of 400 to 650° C. temperature.

EXAMPLES

Next, examples of the present invention will be explained.

Each molten steel having the chemical compositions of Table 1 was cast by a secondary cooling rate shown in Table 2, hot rolled under the conditions shown in Table 2 to obtain a steel plate, then subjected to various tests to evaluate the mechanical properties. For the tensile test piece, a JIS No. 4 test piece was taken from each steel plate at a location of ¼5 of the plate thickness and evaluated for YS (0.2% yield strength), TS, and EI. The matrix toughness was evaluated by obtaining a 2 mm V-notch test piece from each steel plate at ¼t the plate thickness, conducting a Charpy impact test at −40° C., and determining the obtained impact absorption energy value. The HAZ toughness was evaluated by the impact absorption energy value obtained by a Charpy impact test at −40° C. on a steel plate subjected to a reproduced heat cycle test equivalent to a weld input heat of 10 kJ/mm. Note that the cooling rate at the time of casting shown in Table 2 is the cooling rate at the time of secondary cooling calculated by calculation by solidification values. Further, the bainite percentage shown in Table 3 was evaluated by observation by an optical microscope of the structure of the steel plate etched by Nital. For convenience, the parts other than the grain boundary ferrite and MA are deemed to be a bainite structure.

Table 3 summarizes the mechanical properties of the different steel plates. The Steels 1 to 22 show steel plates of examples of the present invention. As clear from Table 1 and Table 2, these steel plates satisfy the requirements of the chemical compositions and the production conditions. As shown in Table 3, the matrix properties are superior and even at high heat input welding, the −40° C. Charpy impact energy value is 150 J or more, that is, the toughness is high. Further, if in the prescribed ranges, even if adding Mo, V, Cr, Ca, and Mg, toughness is obtained even with tempering.

On the other hand, Steels 23 to 36 show comparative examples outside the scope of the present invention. These steels differ from the invention in the conditions of the amount of Mn (Steels 23 and 28), the amount of C (Steels 32 and 33), the amount of Nb (Steels 24 and 35), the amount of Ti (Steel 25), the amount of Si (Steel 26), the amount of Al (Steel 34), the amount of N (Steel 27), the amounts of Mo and V (Steel 29), the amount of Cr (Steel 27), the amounts of Ca and Mg (Steel 31), the cooling rate at the time of casting (Steel 25), the tempering (Steel 30), the cumulative reduction rate (Steels 28 and 32), the reheating temperature (Steel 31), the cooling start temperature after rolling (Steel 36), and the bainite fraction (Steels 32 and 35), so can be said to be inferior in HAZ toughness.

TABLE 1

| | | Chemical compositions (mass %) | | | | | | | | | | | | | | |
|---|---|---|---|---|---|---|---|---|---|---|---|---|---|---|---|---|
| | | C | Si | Mn | P | S | Al | Ti | Nb | N | Cu + Ni | Mo | V | Cr | Ca | Mg |
| Inv. steel | 1 | 0.07 | 0.10 | 1.8 | 0.005 | 0.003 | 0.022 | 0.010 | 0.027 | 0.0050 | 0.04 | — | — | — | — | — |
| | 2 | 0.08 | 0.05 | 1.9 | 0.004 | 0.002 | 0.018 | 0.010 | 0.018 | 0.0044 | 0.02 | — | — | 0.3 | 0.0026 | — |
| | 3 | 0.08 | 0.10 | 2.1 | 0.004 | 0.004 | 0.021 | 0.025 | 0.020 | 0.0048 | 0.05 | — | — | — | — | 0.0034 |
| | 4 | 0.06 | 0.13 | 2.7 | 0.004 | 0.003 | 0.015 | 0.010 | 0.019 | 0.0046 | 0.03 | — | — | — | — | — |
| | 5 | 0.06 | 0.22 | 2.2 | 0.004 | 0.004 | 0.022 | 0.010 | 0.040 | 0.0046 | 0.00 | — | — | — | 0.0033 | — |
| | 6 | 0.06 | 0.14 | 2.3 | 0.004 | 0.004 | 0.020 | 0.010 | 0.020 | 0.0039 | 0.01 | — | — | — | — | — |
| | 7 | 0.09 | 0.13 | 1.8 | 0.004 | 0.002 | 0.016 | 0.018 | 0.010 | 0.0037 | 0.02 | — | — | — | — | — |
| | 8 | 0.08 | 0.10 | 1.8 | 0.004 | 0.003 | 0.031 | 0.011 | 0.020 | 0.0044 | 0.06 | — | 0.01 | — | — | — |
| | 9 | 0.09 | 0.15 | 1.6 | 0.005 | 0.002 | 0.012 | 0.011 | 0.008 | 0.0035 | 0.02 | — | — | — | 0.0025 | — |
| | 10 | 0.03 | 0.18 | 2.0 | 0.004 | 0.004 | 0.003 | 0.022 | 0.052 | 0.0044 | 0.01 | 0.08 | — | 0.2 | — | — |
| | 11 | 0.06 | 0.25 | 2.0 | 0.004 | 0.004 | 0.019 | 0.010 | 0.019 | 0.0049 | 0.00 | — | 0.03 | — | — | — |
| | 12 | 0.07 | 0.10 | 2.0 | 0.004 | 0.003 | 0.017 | 0.010 | 0.019 | 0.0044 | 0.07 | 0.03 | 0.01 | — | — | — |
| | 13 | 0.05 | 0.18 | 1.9 | 0.003 | 0.003 | 0.021 | 0.010 | 0.018 | 0.0042 | 0.02 | — | — | 0.1 | — | — |
| | 14 | 0.12 | 0.08 | 1.5 | 0.004 | 0.004 | 0.002 | 0.006 | 0.019 | 0.0044 | 0.01 | — | — | — | 0.0028 | — |
| | 15 | 0.08 | 0.15 | 1.3 | 0.004 | 0.003 | 0.042 | 0.011 | 0.020 | 0.0046 | 0.03 | — | — | — | — | — |
| | 16 | 0.10 | 0.09 | 2.2 | 0.004 | 0.004 | 0.016 | 0.029 | 0.019 | 0.0038 | 0.01 | — | — | — | — | 0.0026 |
| | 17 | 0.04 | 0.16 | 1.9 | 0.003 | 0.003 | 0.021 | 0.012 | 0.019 | 0.0042 | 0.03 | — | — | — | — | — |
| | 18 | 0.06 | 0.15 | 1.5 | 0.004 | 0.003 | 0.018 | 0.015 | 0.020 | 0.0041 | 0.01 | — | — | — | — | — |
| | 19 | 0.07 | 0.12 | 1.3 | 0.003 | 0.002 | 0.014 | 0.009 | 0.014 | 0.0038 | 0.02 | — | — | — | — | — |
| | 20 | 0.05 | 0.18 | 1.8 | 0.003 | 0.003 | 0.015 | 0.013 | 0.018 | 0.0046 | 0.02 | — | — | — | 0.0025 | 0.0031 |
| | 21 | 0.07 | 0.13 | 1.6 | 0.004 | 0.003 | 0.017 | 0.012 | 0.019 | 0.0051 | 0.05 | — | — | — | 0.0029 | 0.0028 |
| | 22 | 0.08 | 0.19 | 1.5 | 0.003 | 0.002 | 0.019 | 0.020 | 0.022 | 0.0039 | 0.03 | — | — | — | 0.0022 | 0.0026 |
| Comp. steel | 23 | 0.09 | 0.15 | 1.1 | 0.004 | 0.002 | 0.016 | 0.010 | 0.026 | 0.0047 | 0.04 | — | — | — | — | — |
| | 24 | 0.09 | 0.10 | 1.5 | 0.004 | 0.003 | 0.018 | 0.010 | 0.108 | 0.0046 | 0.02 | — | — | — | — | — |
| | 25 | 0.09 | 0.05 | 1.5 | 0.004 | 0.003 | 0.016 | 0.033 | 0.020 | 0.0040 | 0.02 | — | — | — | — | — |
| | 26 | 0.08 | 0.36 | 2.0 | 0.004 | 0.003 | 0.020 | 0.011 | 0.009 | 0.0034 | 0.05 | — | — | — | 0.0027 | — |
| | 27 | 0.08 | 0.15 | 2.0 | 0.004 | 0.003 | 0.015 | 0.011 | 0.011 | 0.0070 | 0.02 | — | — | 0.6 | — | — |
| | 28 | 0.08 | 0.15 | 3.2 | 0.004 | 0.003 | 0.012 | 0.011 | 0.020 | 0.0042 | 0.00 | — | — | — | — | 0.0027 |
| | 29 | 0.08 | 0.15 | 2.0 | 0.004 | 0.003 | 0.010 | 0.011 | 0.020 | 0.0037 | 0.03 | 0.16 | 0.09 | — | — | — |
| | 30 | 0.09 | 0.16 | 2.0 | 0.005 | 0.002 | 0.018 | 0.010 | 0.021 | 0.0032 | 0.01 | — | — | — | — | — |
| | 31 | 0.08 | 0.19 | 1.6 | 0.005 | 0.003 | 0.005 | 0.010 | 0.017 | 0.0036 | 0.04 | — | — | — | 0.0038 | 0.0052 |
| | 32 | 0.02 | 0.12 | 1.6 | 0.005 | 0.003 | 0.016 | 0.011 | 0.018 | 0.0035 | 0.06 | — | — | — | — | — |
| | 33 | 0.16 | 0.10 | 1.1 | 0.005 | 0.004 | 0.018 | 0.011 | 0.019 | 0.0041 | 0.05 | — | — | — | — | — |
| | 34 | 0.07 | 0.12 | 1.5 | 0.004 | 0.004 | 0.054 | 0.010 | 0.022 | 0.0035 | 0.02 | — | — | — | — | — |
| | 35 | 0.05 | 0.06 | 1.3 | 0.005 | 0.003 | 0.024 | 0.011 | 0.002 | 0.0044 | 0.01 | — | — | — | — | — |
| | 36 | 0.04 | 0.14 | 1.6 | 0.005 | 0.006 | 0.015 | 0.011 | 0.018 | 0.0026 | 0.03 | — | — | — | — | — |

TABLE 2

| | | Plate thickness (mm) | Cooling rate at casting (° C./s) | Production conditions: Reheating temp. (° C.) | Cumulative reducetion rate (%) | Cooling start temp. (° C.) | Cooling rate (° C./s) | Tempering (° C.) |
|---|---|---|---|---|---|---|---|---|
| Inv. steel | 1 | 60 | 0.18 | 1150 | 50 | 848 | 6 | — |
| | 2 | 60 | 0.08 | 1100 | 40 | 832 | 10 | — |
| | 3 | 60 | 0.23 | 1150 | 50 | 842 | 12 | — |
| | 4 | 60 | 0.41 | 1150 | 40 | 821 | 5 | — |
| | 5 | 60 | 0.09 | 1200 | 60 | 847 | 10 | — |
| | 6 | 60 | 0.19 | 1150 | 50 | 816 | 10 | — |
| | 7 | 60 | 0.22 | 1150 | 40 | 822 | 8 | 500 |
| | 8 | 80 | 0.11 | 1150 | 50 | 834 | 10 | 550 |
| | 9 | 60 | 0.09 | 1150 | 40 | 850 | 10 | — |
| | 10 | 60 | 0.10 | 1150 | 50 | 844 | 10 | — |
| | 11 | 60 | 0.32 | 1150 | 60 | 812 | 9 | — |
| | 12 | 60 | 0.15 | 1150 | 50 | 834 | 10 | — |
| | 13 | 50 | 0.12 | 1150 | 40 | 844 | 15 | — |
| | 14 | 50 | 0.16 | 1150 | 50 | 847 | 10 | — |
| | 15 | 60 | 0.24 | 1150 | 50 | 826 | 18 | — |
| | 16 | 60 | 0.19 | 1150 | 50 | 809 | 10 | — |
| | 17 | 80 | 0.12 | 1150 | 40 | 819 | 8 | — |
| | 18 | 60 | 0.16 | 1200 | 50 | 815 | 6 | — |
| | 19 | 50 | 0.15 | 1150 | 50 | 843 | 10 | — |
| | 20 | 60 | 0.21 | 1200 | 40 | 820 | 16 | — |
| | 21 | 60 | 0.18 | 1150 | 60 | 831 | 12 | — |
| | 22 | 50 | 0.16 | 1150 | 40 | 816 | 9 | — |
| Comp. steel | 23 | 60 | 0.08 | 1150 | 40 | 810 | 10 | — |
| | 24 | 60 | 0.13 | 1150 | 50 | 805 | 8 | — |
| | 25 | 60 | 0.02 | 1150 | 50 | 824 | 10 | — |
| | 26 | 60 | 0.10 | 1150 | 60 | 813 | 10 | — |
| | 27 | 60 | 0.09 | 1150 | 50 | 842 | 5 | — |
| | 28 | 60 | 0.07 | 1150 | 30 | 822 | 10 | — |
| | 29 | 60 | 0.08 | 1150 | 50 | 816 | 12 | — |
| | 30 | 80 | 0.15 | 1150 | 50 | 841 | 10 | 660 |
| | 31 | 60 | 0.09 | 1250 | 50 | 830 | 10 | — |
| | 32 | 60 | 0.10 | 1150 | 35 | 826 | 9 | — |
| | 33 | 60 | 0.09 | 1150 | 50 | 813 | 3 | — |
| | 34 | 60 | 0.09 | 1150 | 50 | 818 | 10 | — |
| | 35 | 60 | 0.09 | 1150 | 50 | 835 | 10 | — |
| | 36 | 60 | 0.09 | 1150 | 50 | 740 | 10 | — |

TABLE 3

| | | Matrix structure: Bainite fraction (%) | Matrix characteristics: Strength: YS (MPa) | TS (MPa) | EL (%) | YR (%) | Toughness: vE-40(J) (Av) | HAZ characteristic: Toughness: vE-40(J) (Av) |
|---|---|---|---|---|---|---|---|---|
| Inv. steel | 1 | 85 | 480 | 648 | 22 | 74 | 272 | 170 |
| | 2 | 91 | 508 | 706 | 21 | 72 | 258 | 161 |
| | 3 | 96 | 556 | 762 | 18 | 73 | 261 | 163 |
| | 4 | 99 | 592 | 789 | 21 | 75 | 250 | 155 |
| | 5 | 95 | 553 | 747 | 19 | 74 | 260 | 163 |
| | 6 | 94 | 532 | 739 | 22 | 72 | 259 | 162 |
| | 7 | 81 | 525 | 611 | 17 | 86 | 269 | 168 |
| | 8 | 80 | 502 | 597 | 20 | 84 | 271 | 169 |
| | 9 | 89 | 501 | 686 | 22 | 73 | 273 | 171 |
| | 10 | 80 | 457 | 601 | 18 | 76 | 268 | 167 |
| | 11 | 86 | 485 | 655 | 20 | 74 | 267 | 167 |
| | 12 | 88 | 500 | 676 | 16 | 74 | 265 | 166 |
| | 13 | 82 | 446 | 619 | 23 | 72 | 268 | 168 |
| | 14 | 97 | 576 | 769 | 19 | 75 | 271 | 169 |
| | 15 | 81 | 437 | 615 | 21 | 71 | 284 | 178 |
| | 16 | 98 | 627 | 825 | 17 | 76 | 255 | 159 |
| | 17 | 86 | 426 | 553 | 20 | 77 | 273 | 170 |
| | 18 | 84 | 420 | 553 | 18 | 76 | 281 | 175 |
| | 19 | 81 | 408 | 517 | 22 | 79 | 285 | 178 |
| | 20 | 87 | 439 | 577 | 21 | 76 | 274 | 171 |
| | 21 | 91 | 459 | 621 | 23 | 74 | 276 | 173 |
| | 22 | 84 | 480 | 639 | 20 | 75 | 277 | 173 |

TABLE 3-continued

| | | Matrix structure | Matrix characteristics | | | | | HAZ characteristic |
|---|---|---|---|---|---|---|---|---|
| | | Bainite | Strength | | | | Toughness | Toughness |
| | | fraction (%) | YS (MPa) | TS (MPa) | EL (%) | YR (%) | vE-40(J) (Av) | vE-40(J) (Av) |
| Comp. steel | 23 | 83 | 453 | 629 | 17 | 72 | 249 | 41 |
| | 24 | 98 | 591 | 778 | 17 | 76 | 230 | 38 |
| | 25 | 88 | 498 | 682 | 21 | 73 | 231 | 38 |
| | 26 | 95 | 549 | 753 | 11 | 73 | 206 | 34 |
| | 27 | 94 | 533 | 740 | 21 | 72 | 173 | 29 |
| | 28 | 99 | 721 | 962 | 16 | 75 | 148 | 25 |
| | 29 | 97 | 538 | 769 | 16 | 70 | 195 | 33 |
| | 30 | 85 | 560 | 651 | 26 | 86 | 208 | 35 |
| | 31 | 87 | 495 | 669 | 31 | 74 | 227 | 38 |
| | 32 | 67 | 339 | 471 | 24 | 72 | 243 | 40 |
| | 33 | 98 | 628 | 884 | 16 | 71 | 228 | 38 |
| | 34 | 81 | 446 | 612 | 16 | 73 | 236 | 39 |
| | 35 | 66 | 337 | 456 | 16 | 74 | 253 | 42 |
| | 36 | 73 | 378 | 525 | 16 | 72 | 240 | 40 |

INDUSTRIAL APPLICABILITY

According to the present invention, a steel material suppressing crystal grain growth at the HAZ due to welding and having an extremely stable, high level of HAZ toughness is obtained.

The invention claimed is:

1. A method of production of steel for welded structures excellent in low temperature toughness of the weld heat affected zone (HAZ), characterized by preparing a molten steel comprised of, by mass %, C: 0.03 to 0.12%,
Si: 0.05 to 0.30%,
Mn: 1.6 to 3.0%,
P: 0.015% or less,
S: 0.002 to 0.015%,
Cu+Ni: 0.10% or less,
Al: 0.001 to 0.050%,
Ti: 0.005 to 0.030%,
Nb: 0.005 to 0.10%,
N: 0.0025 to 0.0060%, and a balance of iron and unavoidable impurities, and casting the molten steel by a continuous casting method to obtain a slab, cooling the slab at a cooling rate from near the solidification point to 800° C. of 0.1 to 0.6° C./s, followed by reheating the slab to a temperature between 1100° C. and 1200° C., hot rolling the slab to obtain a steel plate in a pre-recrystallization temperature range by a cumulative reduction rate of 40% or more, finishing the hot rolling at 850° C. or more, followed by cooling the steel plate from 800° C. or more at a cooling rate of 5° C./s or more to 400° C. or less.

2. A method of production of steel for welded structures excellent in low temperature toughness of the weld heat affected zone (HAZ) as set forth in claim 1, characterized by said molten steel further containing, by mass %, one or more of Mo: 0.2% or less,
V: 0.03% or less,
Cr: 0.5% or less,
Ca: 0.0035% or less, and
Mg: 0.0050% or less.

3. A method of production of steel for welded structures excellent in low temperature toughness of the weld heat affected zone (HAZ) as set forth in claim 1, said method of production characterized by after cooling the steel plate obtained by said hot rolling, tempering the steel plate at 400 to 650° C.

* * * * *